United States Patent [19]

Kawamura et al.

[11] 4,315,485

[45] Feb. 16, 1982

[54] VAPOR GENERATOR FOR FUELS HAVING DIFFERENT FLAME RADIATION INTENSITIES

[75] Inventors: Tomotsuchi Kawamura, Chiba; Hisao Haneda, Yokohama, both of Japan

[73] Assignees: Sulzer Brothers Limited, Winterthur, Switzerland; Mitsubishi Heavy Industries Ltd., Tokyo, Japan

[21] Appl. No.: 179,790

[22] Filed: Aug. 20, 1980

[30] Foreign Application Priority Data

Aug. 22, 1980 [CH] Switzerland ..... 7648/79

[51] Int. Cl.[3] ..... F22D 7/00

[52] U.S. Cl. ..... 122/406 R; 122/22; 122/25

[58] Field of Search ..... 122/406 R, 406 B, 406 S, 122/406 ST, 23, 25, 4 R, 22, 479 B, 479 C

[56] References Cited

U.S. PATENT DOCUMENTS 3,115,122 12/1963 Stallkamp ..... 122/406 R

FOREIGN PATENT DOCUMENTS 1266312 4/1968 Fed. Rep. of Germany ... 122/406 R

*Primary Examiner*—Edward G. Favors

*Attorney, Agent, or Firm*—Kenyon & Kenyon

[57] ABSTRACT

The vapor generator employs a convection heating surface in the gas flue upstream of the superheater heating surface in the exhaust gas flow. The burners for the different fuels are disposed in a common horizontal plane in the combustion chamber.

In one embodiment, one water separator is disposed between the evaporator and convection heating surfaces while a second water separator is disposed between the convection and superheater heating surfaces.

In another embodiment, one separator only is used with a change-over circuit means to connect the separator either between the evaporator and convection heating surfaces or between the convection and superheater heating surfaces.

8 Claims, 5 Drawing Figures

FIG. 1
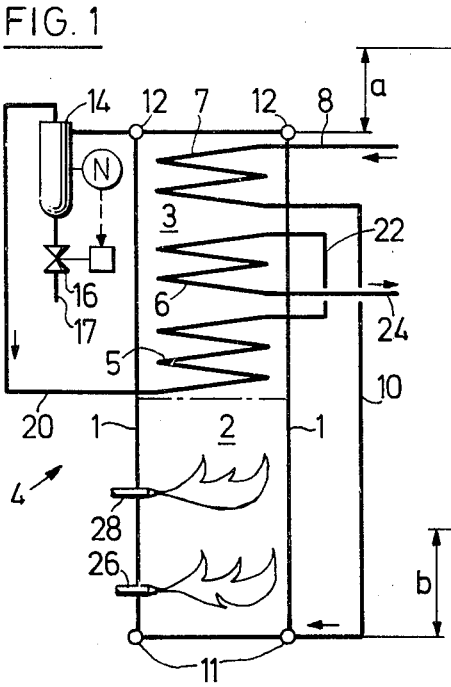
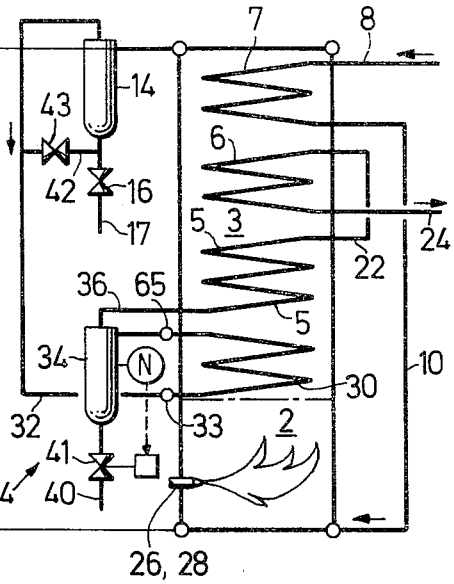
FIG. 2
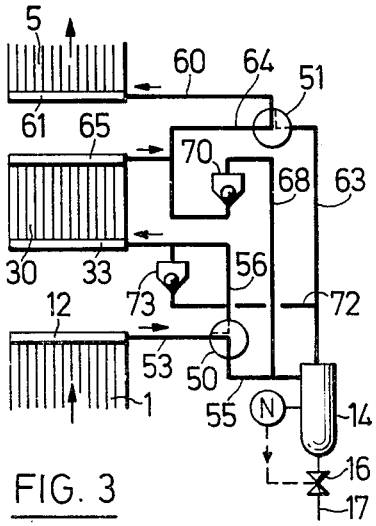
FIG. 3
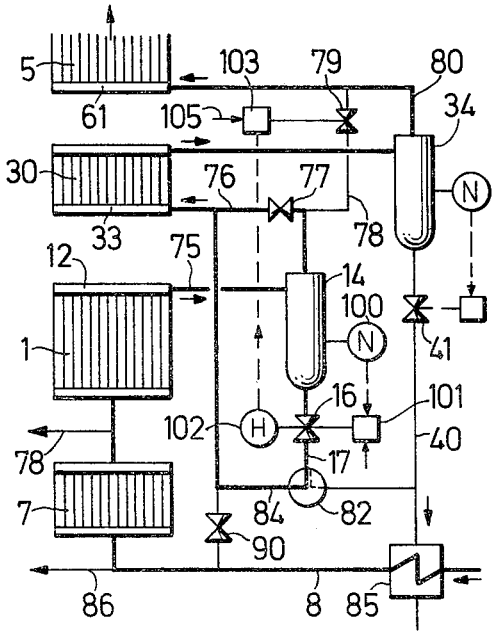
FIG. 5
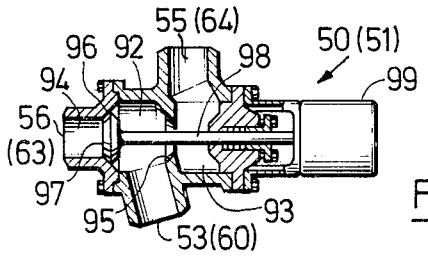
FIG. 4

VAPOR GENERATOR FOR FUELS HAVING DIFFERENT FLAME RADIATION INTENSITIES

This invention relates to a vapor generator for fuels having different flame radiation intensities.

Heretofore, it has been known to construct vapor generators for use with fuels of different flame radiation intensities. For example, it has been known to construct a vapor generator with an evaporator heating surface which defines a combustion chamber and an exhaust gas flue, superheater heating surfaces above the combustion chamber and burners for different fuels, for example oil and methane, within the combustion chamber. In such vapor generators, it has been proposed to position the burners for fuels of lower flame radiation intensity farther away from the superheater surfaces at the top end of the combustion chamber than corresponding burners for fuels of stronger flame radiation intensity. Consequently, the combustion chamber wall which is connected as the evaporator heating surface absorbs substantially the same amount of radiant heat irrespective of the type of fuel used. However, such a construction requires a very large combustion chamber.

Accordingly, it is an object of the invention to provide a vapor generaator for burning fuels of different flame radiation intensities which is of relatively compact size.

It is another object of the invention to reduce the cost of constructing vapor generators capable of burning fuels having diffeent flame radiation intensities.

Briefly, the invention is directed to a vapor generator which has an evaporator heating surface for a working medium which is formed of tubes to define a combustion chamber and an exhaust gas flue above the combustion chamber, at least one burner each in the combustion chamber for a high flame radiation fuel and a low flame radiation fuel, and a superheater heating surface in the flue. In accordance with the invention, the burners are disposed at a common level in the combustion chamber to produce a flame and a flow of exhaust gas. In addition, a plurality of tubes which define a convection heating surface for the working medium are disposed within the flue for passage of a flow of exhaust gas thereover in heat exchange relation with the working medium therein. This convection heating surface is positioned so that the superheater surface is downstream of the convection heating surface relative to the flow of working medium and a flow of exhaust gas. Also, a water separator is connected between the convection and superheater heating surfaces for conducting the flow of working medium therebetween.

When the vapor generator is fired with a fuel of high flame radiation intensity, the convection heating surface acts as a pre-superheater for the working medium, while, in the case of operation with a fuel of low flame radiation intensity, the convection heating surface acts as a post-evaporator for the working medium.

One advantage of the vapor generator is that the total surface of the heated tubes is reduced, because the entire surface of the convection heating surface tubes takes part in the heat exchange, unlike conditions in the case of the combustion chamber tubes. The total tubing of the vapor generator is thus lighter and cheaper so that the additional expenditure necessary for the convection heating surface can be accepted without increasing the overall costs.

In another embodiment, a second water separator is connected between the convection heating surface and the superheater heating surface in the flow of working medium. In this embodiment, a water conduit extends from a water outlet of the first separator in the working flow path to expel water, a vapor conduit extends from a vapor outlet of the first separator to the convection heating surface to deliver working medium thereto and a selectively closeable conduit extends from the water conduit to the vapor conduit to selectively deliver water to the vapor conduit. With this construction, water which collects in the first separator in the flow path during operation with the low flame radiation fuel, e.g. when a level-controlled water outlet valve is closed, is not abruptly discharged through a vapor outlet of the first separator. Thus, distribution difficulties which might otherwise arise in the tubes of the convection heating surface are obviated. Further, the uniform addition of water from the first separator to the vapor flow gives a homogeneous mixture of water and vapor which generally results in stable conditions, given a suitable arrangement of distributors to which the convection heating surface tubes are connected.

In one embodiment where only one water separator need be used, a change-over circuit means is used for selectively connecting the water separator either between the evaporator heating surface and the convection heating surface or between the convection heating surface and the superheater heating surfaces. This is not only financially advantageous, but also is of advantage structurally because of the saving in space.

Where regulatory authorities may require special safety valves to be fitted to an evaporator heating surface to ensure discharge from the evaporator in the event of incorrect operation of a change-over circuit means, the need for such valves can be eliminated in the vapor generator. To this end, the circuit means is provided with a three-way valve with an inlet connected to the evaporator heating surface to receive working medium therefrom, a first outlet selectively connected to the water separator and a second outlet selectively connected to the convection heating surface. In addition, a second three-way valve is provided with a first inlet selectively connected to the convection heating surface to receive working medium therefrom, a second inlet selectively connected to the water separator to receive working medium therefrom and an outlet connected to the superheater heating surface. Further, a non-return valve is connected between an outlet of the water separator and the convection heating surface to permit a flow of working medium from the separator to the convection heating surface with the second inlet of the second three-way valve closed to the separator. Still further, a second non-return valve is connected between the convection heating surface and the separator to permit a flow of working medium from the convection heating surface to the separator with the first inlet of the second three-way valve closed to the convection heating surface. Thus, vapor can be fed from the separator to the convection heating surface or a mixture of water and vapor can be fed from the convection heating surface to the separator. With the circuit indicated, the pressure in all the heating surfaces can be monitored by main safety valves at the generator end, even if the change-over circuit means is incorrectly operated in some way.

In the embodiment where two water separators are used, the first water separator has a water outlet selectively connected to one of an inlet of the convection heating surface and a water outlet of the second water separator as well as a vapor outlet selectively connected to one of the inlet of the convection heating surface and an inlet of the superheater surface. In this case also, an adjustable valve is disposed between the inlet of the superheater heating surface and the vapor outlet of the first separator for controlling a flow of working medium therebetween. In this case, the working medium is always supplied in a single-phase condition, i.e., either as water or as vapor.

In addition, a throttle such as a control valve can be disposed at the water outlet of the first separator for controlling the water level therein. In addition, a position transmittor can be mounted on the throttle and connected to the adjustable valve so that during operation of the burner for low flame radiation fuel, the throttle remains in a predetermined opening range. The control circuit which is provided in this regard has the advantage that the pressure drop at the changeover members is kept to a minimum.

Still further, a level transmitter can be connected to the first water separator for determining the level of the water therein while being selectively connected to one of the throttle and the adjustable valve in order to adjust the water level in the first separator.

These and other objects and advantages of the invention will become more apparent from the following detailed description taken in conjunction with the accompanying drawings in which:

FIG. 1 diagrammatically illustrates a vapor generator according to the prior art;

FIG. 2 diagrammatically illustrates a vapor generator constructed in accordance with the invention;

FIG. 3 diagrammatically illustrates a modified vapor generator constucted in accordance with the invention;

FIG. 4 illustrates a partial cross-sectional view of a three-way valve according to the invention; and FIG. 5 diagrammatically illustrates a further modified vapor generator construction in accordance with the invention.

Referring to FIG. 1, the vapor generator 4 which is of known construction includes an evaporator heating surface 1 for a working medium which defines the walls of a combustion chamber 2 and an exhaust gas flue 3 above the combustion chamber 2.

As considered in the direction of flow of the exhaust gases, the flue 3 contains a first superheater 5, a final superheater 6 and an economizer surface 7. The economizer surface 7 is connected to a feed system (not shown) via a feed conduit 8 and has an outlet connected to a connecting conduit 10 leading to bottom collectors 11 of the walls 1. The tubes of the walls 1 lead into collectors 12 connected to an inlet to a water separator 14. The separator 14 has a water outlet connected, in the usual way, to a water return condiut 17 via a level-controlled valve 16 and a vapor outlet connected to a conduit 20 which leads to the first superheater 5. A conduit 22 connects the outlet of the first superheater 5 to the inlet of the final superheater 6 and a live vapor line 24 leads from the outlet of the final superheater 6 to a vapor consuming circuit (not shown). Methane burners 26 are located at a bottom level and oil burners 28 at a higher level in the combustion chamber 2.

The position of the burners 26, 28 is so selected that irrespective of which of the burners 26, 28 is in operation, the temperature of the exhaust gases at the entry to the zone of the superheaters 5, 6 (constructed as convection heating surfaces) is at about the same temperature. Thus, depending upon the load, equal quantities of vapor are produced and superheated to approximately the same temperature so that only slight corrections are necessary by water injection, exhaust gas circulation or the like.

Because of the low flame radiation of methane, this construction requires a very large combustion chamber.

Referring to FIG. 2, wherein like reference characters indicate like parts as above, the vapor generator 4 has a combustion chamber 2 which is much smaller than that of FIG. 1 and the burners 26, 28 for methane and oil, respectively, are disposed at a common level in the combustion chamber 2. A convection heating surface 30 is also provided beneath the superheater 5 in the flue 3 and is fed with working medium from the separator 14 via a conduit 32 and a header 33. The convection heating surface 30 is formed of tubes and, on the outlet side is connected to the inlet of a second separator 34. A vapor outlet of the separator 34 is connected via a conduit 36 to the inlet to the superheater 5. Water is removed from the separator 34 via a water return conduit 40 containing a valve 41 controlled by a level controller.

A branch conduit 42 containing a valve 43 and leading into the conduit 32 is connected to the water outlet of separator 14 upstream of the control valve 16.

During operation with the oil burners 28, a very bright flame results in the combustion chamber 2 and the walls 1 absorbing a heat output such that the water flowing in the tubes is largely or possibly completely evaporated at the outlet from the collectors 12. The water and vapor mixture flows in to the separator 14, where the water is discharged via the water conduit 17 extending from a water outlet of the separator 14. The vapor flows from a vapor outlet via the conduit 32 past the conduit 42 in which the closed valve 43 is positioned to the convection heating surface 30 in which the vapor is presuperheated. The second separator 34 is run dry and the valve 41 is closed. The vapor in presuperheated form flows into the superheaters 5, 6 between which the vapor may be cooled by conventional water injection if required, thus being brought to the final temperature in the live vapor line 24. Instead of increased water injection, flue gas circulation may be included or intensified.

In the case of operation with methane, the burners 26 are in operation. Because of the reduced flame radiation of methane, the walls 1 absorb a lower heat output so that the vapor in the collectors 12 has a high water content. The valve 16 of the separator 14 is now, for example, fully closed and valve 43 is opened, so that the water separated in the separator 14 is continually mixed intimately with the separated vapor at the point where the conduit 42 leads into the conduit 32. The result is a water and vapor mixture of constant humidity at constant load. The mixture of water and vapor is distributed over the parallel tubes of the convection heating surface 30 via conventional means adapted to render the mixture distribution uniform, and the mixture is largely or completely evaporated here. Any water present at the outlet from the convection heating surface 30 is separated in the separator 34 and discharged via the level-controlled valve 41. The saturated vapor flows on via conduit 36 to the superheaters 5, 6 and then to the consumer circuit (not shown).

The vapor generator shown in FIG. 2 has a much smaller height than a similar prior art vapor generator. To illustrate this, FIGS. 1 and 2 are drawn to the same scale and so disposed that the top edge of each combustion chamber 2 is at the same height. This top edge is denoted by the chain-line. The convection heating surface 30 occupies only a small height of the vapor generator, which is much smaller than shown in the drawing. Accordingly, the dimension a between the top edges of the vapor generators in FIGS. 1 and 2, which is equivalent to the space required by the convection heating surface 30, is much smaller than shown and is also much smaller than the dimension b at the bottom edge of the vapor generator. This indicates the saving in combustion chamber height.

Referring to FIG. 3, wherein the like reference characters indicate like parts as above, the vapor generator can be constructed to use only one separator 14. To this end, a change-over-circuit means is used for selectively connecting the single separator 14 between the heating surfaces 1 and 30 or between the heating surfaces 30 and 5. This circuit means contains two three-way valves 50, 51 and two non-return valves 70, 73. The inlet of one three-way valve 50 is connected via a conduit 53 to the outlet collector 12 of wall 1 defining the evaporator heating surface to receive working medium while the two outlets of the three-way valve 50 selectively lead via a conduit 55 to the separator 14 and via a conduit 56 to the inlet collector 33 of the convection heating surface 30. The three-way valve 51 has a single outlet which is connected to an inlet collector 61 of the first superheater 5 via a conduit 60. The two inlets of the three-way valve 51 are selectively connected to the outlet collector 65 of the convection heating surface 30 via conduit 64 and to the vapor outlet of the separator 14 via a conduit 63. The non-return valve 70 is provided in a cross-conduit 68 leading from conduit 64 to conduit 55 so as to be connected between the outlet of the convection heating surface 30 and the separator 14 to permit a flow in the one direction but not in the other. Another cross-conduit 72 is provided between conduit 63 and conduit 56 and contains the non-return valve 73. The valve 73 is thus connected between the convection heating surface 30 and separator 14 to permit a flow of working medium only from the separator 14 to the convection heating surface 30.

The separator 14 is provided with a level-controlled valve 16 via which separated water can flow back to a feed tank (not shown).

In the case of operation with oil, the three-way valves 50 and 51 are in the continuous-line position shown. The mixture of water and vapor flows from the walls 1 via the conduits 53, 55 to the separator 14, from which the water is discharged downwards. The vapor separated in the separator 14 passes through the cross-conduit 72 and the non-return valve 73 to the convection heating surface 30 and is pre-superheated therein and then flows on to the superheater 5 via the conduit 64 and the three-way valve 51.

For operation with methane, the three-way valves 50, 51 are brought into the position shown in chain lines. The mixture of water and vapor produced in the walls 1 flows through the conduits 53, 56 to the convection heating surface 30 and then via the cross-conduit 68 containing the non-return valve 70 to the separator 14. The separated water is, in turn, discharged via the valve 16, while the vapor flows via the conduit 63, three-way valve 51 and conduit 60 to the superheater 5.

When three-way valves of the kind shown in FIG. 4 are used, the circuit illustrated has the advantage that the individual heating surfaces cannot be isolated from one another even in the unlikely case of one of the valves 50, 51 not functioning. There is therefore no need to protect the heating surfaces 1, 30 from excess pressure by means of special safety valves. As shown in FIG. 4, each valve 50 comprises a middle chamber 92 and two outer chambers 93, 94. A seat surface 95, 96 is provided between the middle chamber 92 and each of the outer chambers 93, 94, and either one of the seat surfaces, but not both, is occupied by a closure member 97 at any time. The member 97 is connected by a valve spindle 98 to a piston (not shown) of a hydraulic servomotor 99 which can be run from one end position to the other by suitable means (not shown). Spigots 53, 55 and 56 are connected to the middle chamber 92 and the two outer chambers 93, 94 and their references correspond to the conduits in FIG. 3. The numbers 60, 63 and 64 in brackets correspond to the valve 51 in FIG. 3.

Referring to FIG. 5, wherein like reference characters indicate like parts as above, the vapor generator can be constructed with a pair of water separators 14, 34. In this embodiment, a further control circuit is provided for controlling the operation of the vapor generator. As shown, the first separator 14 is connected on the input side to the outlet collectors 12 via a conduit 75. A line 76 leads from the vapor outlet of the separator via a valve 77 to the inlet collector 33 of the convection heating surface 30. Another line 78 connects the vapor outlet of separator 14 via an adjustable valve 79 to a vapor outlet conduit 80 of the separator 34. This conduit 80 leads to the inlet collector 61 of the superheater 5. The water outlet of separator 14 leads via the control valve or throttle 16 to a three-way valve 82, one outlet of which is connected via a conduit 84 to the inlet collector 33 of the convection heating surface 30. The other outlet of the three-way valve 82 is connected to the conduit 40, which discharges water from separator 34 via a valve 41 and leads to a recuperative preheater 85 in the feed conduit 8. Injection water conduits 86, 87 may branch from the feed conduit 8 or from the connecting conduit 10. A connecting conduit having a controllable valve 90 may also be provided between the feed conduit 8 and the conduit 84.

In the case of oil firing, the mixture of water and vapor flows from the walls 1 into the separator 14, from which the water flows back to the feed water tank (not shown) via the chain-line path of the three-way valve 82 and the conduit 40 through the recuperative preheater 85, while the vapor flows past the closed valve 79 through the fully open valve 77 and the convection heating surface 30 and on through the separator 34, which is operated in the dry state, and the conduit 80 to the superheater 5.

With methane firing, the three-way valve 82 is in the solid-line position. The mixture of water and vapor from the walls 1 now flows with a high water content to the separator 14. The separated water flows via the conduit 84 to the convection heating surface 30 where the water is largely evaporated. The mixture flows to the separator 34 from which the vapor flows to the superheater 5 via the conduit 80. The separated water flows via the conduit 40 to the preheater 85.

The vapor separated in the separator 14 flows via the conduit 78 and the valve 79 into the conduit 80 and combines with the vapor from the separator 34, and on to the superheater 5.

The advantage of this circuit is that the collector 33 of the convection heating surface 30 is always fed with single-phase medium, i.e. with water or vapor. This obviates any distribution problems even under difficult conditions.

It is important that the pressure differences built up at the valve 79 in the case of methane firing should always be sufficient to drive all the water out of the separator 14 via the valve 16 and conduit 84 into the convection heating surface 30, from which the working medium then flows in vapor form through the separator 34. This is achieved, for example, by means of the control circuit shown in FIG. 5. This comprises a level transmitter 100, a level controller 101, the valve 16, a valve position transmitter 102 on the valve 16, and a valve position controller 103 acting on the valve 79, and the necessary connecting conduits between these units. The level transmitter 100 is connected to the separator 14 for determining the level of water therein and is selectively connected to one of the throttle 16 and the valve 79 to adjust the water level in the separator 14. The control circuit controls the level in the separator 14 primarily by means of the elements 100, 101 and 16. If valve 16 opens more than is indicated by a set-value fed to the controller 103 via a signal line 105, the valve 79 is controlled to close. Conversely, the valve 79 is moved to the fully open position by the controller 103 when the position of the valve 16 does not attain the set value introduced via the line 105.

In the case of oil firing, the set value inroduced to the controller 103 via the line 105 is put at a very high value, e.g. manually, so that the valve 79 is kept closed and all the vapor is fed from the separator 14 via the conduit to the convection heating surface 30.

Instead of the control circuit shown, the level transmitter 100 can be alternately connected to the controllers 101, 103, in which case the valve position transmitter 102 can be eliminated. In the case of oil firing, with the three-way valve 82 pointing towards the conduit 40, valve 79 is closed and valve 16 is used to check the level. All the vapor in these conditions flows through the open valve 77 and the dry separator 34 to the superheater 5.

For methane firing, the three-way valve 82 is switched over. The valve 16 is brought to a fixed value, e.g. fully opened, e.g. manually, and the valve 79 is subjected to the influence of the level transmitter 100, while the valve 77 is closed.

All the circuits described are also suitable for operation with sliding pressure even if the supercritical pressure state is reached in the top load zone, so that there is no separation by phases in any of the separators. If it is expected that the supercritical pressure state will be operated for some time, it may be advantageous, in the case of the circuit shown in FIG. 3, to bring the valve 51 into the continuous-line position and valve 50 into the chain-line position so that the working medium flows past the separator 14 and a pressure loss is thus avoided in the separator 14. If it is expected that there is an imminent unforeseen reduction of the load to the subcritical range, the separator 14 will advantageously be kept hot, e.g. by feeding a small quantity of vapor through small bypass valves (not shown) through the separator 14, bypassing the three-way valves 50, 51.

In the case of part-load operation, a considerable excess of water is preferably used and is provided by a feed pump or by a circulating pump. In the latter case, the recycled water is fed directly to the working medium circuit between the economiser 7 and the walls 1 instead of to the feed tank.

The invention can also be applied to drum type boilers, in which case the separator 14 is replaced by a drum.

What is claimed is:

1. A vapor generator comprising an evaporator heating surface for a working medium defining a combustion chamber and an exhaust gas flue above said combustion chamber;

at least one burner in said combustion chamber for burning a high flame radiation fuel to produce a flame and a flow of exhaust gas;

at least one burner in said combustion chamber for burning a low flame radiation fuel to produce a flame and a flow of exhaust gas, said burners being disposed at a common level in said combustion chamber;

a plurality of tubes defining a convection heating surface for the working medium within said exhaust gas flue and above said combustion chamber for passage of a flow of an exhaust gas thereover in heat exchange relation with the working medium therein;

a superheater heating surface in said flue downstream of said convection heating surface relative to the flow of working medium and a flow of exhaust gas; and a water separator connected between said convection heating surface and said superheater heating surface for conducting the flow of working medium therebetween.

2. A vapor generator as set forth in claim 1 which further comprises a change-over circuit means for selectively connecting said water separator between said evaporator heating surface and said convection heating surface while dis-connecting said water separator from between said convection heating surface and said superheater heating surface.

3. A vapor generator as set forth in claim 2 wherein said circuit means includes a first three-way valve having an inlet connected to said evaporator heating surface to receive working medium therefrom, a first outlet selectively connected to said water separator and a second outlet selectively connected to said convection heating surface;

a second three-way valve having a first inlet selectively connected to said convection heating surface to receive working medium therefrom, a second inlet selectively connected to said water separator to receive working medium therefrom and an outlet connected to said superheater heating surface;

a first non-return valve connected between an outlet of said water separator and said convection heating surface to permit a flow of working medium from said separator to said convection heating surface with said second inlet of said second three-way valve closed to said separator; and a second non-return valve connected between said convection heating surface and said separator to permit a flow of working medium from said convection heating surface to said separator with said first inlet of said second three-way valve closed to said convection heating surfce whereby vapor can be fed from said separator to said convection heating surface or a mixture of water and vapor can be fed from said convection heating surface to said separator.

4. A vapor generator comprising an evaporator heating surface for a working medium defining a combustion chamber and an exhaust gas flue above said combustion chamber;

at least one burner in said combustion chamber for burning a high flame radiation fuel to produce a flame and a flow of exhaust gas;

at least one burner in said combustion chamber for burning a low flame radiation fuel to produce a flame and a flow of exhaust gas, said burners being disposed at a common level in said combustion chamber;

a plurality of tubes defining a convection heating surface for the working medium within said exhaust gas flue and above said combustion chamber for passage of a flow of an exhaust gas thereover in heat exchange relation with the working medium therein;

a superheater heating surface in said flue downstream of said convection heating surface relative to the flow of working medium and a flow of exhaust gas;

a first water separator connected between said evaporator heating surface and said convection heating surface in the flow of working medium; and a second water separator connected between said convection heating surface and said superheater heating surface in the flow of working medium whereby during operation of said burner for high flame radiation fuel, said convection heating surface acts as a pre-superheater for the working medium and during operation of said burner for low flame radiation fuel said convection heating surface acts as a post-evaporator for the working medium.

5. A vapor generator as set forth in claim 4 wherein said first water separator has a water outlet and a vapor outlet, and which further comprises a water conduit extending from said vapor outlet of said separator to said convection heating surface to deliver working medium thereto; and a selectively closeable conduit extending from said water conduit to said vapor conduit to selectively deliver water to said vapor circuit.

6. A vapor generator as set forth in claim 4 wherein said first water separator has a water outlet selectively connected to one of an inlet of said convection heating surface and a water outlet of said second water separator and a vapor outlet selectively connected to one of said inlet of said convection heating surface and an inlet of said superheater heating surface, and which further comprises an adjustable valve between said inlet of said superheater heating surface and said vapor outlet for controlling a flow of working medium therebetween.

7. A vapor generator as set forth in claim 6 which further comprises a throttle at said water outlet for controlling the water level in said first water separator and a position transmitter mounted on said throttle and connected to said adjustable valve whereby during operation of said burner for low flame radiation fuel, said throttle remains in a predetermined opening range.

8. A vapor generator as set forth in claim 7 which further comprises a level transmitter connected to said first water separator for determining the level of water in said first separator and being selectively connected to one of said throttle and said adjustable valve to adjust the water level in said first separator.

* * * * *

UNITED STATES PATENT AND TRADEMARK OFFICE

CERTIFICATE OF CORRECTION

PATENT NO. : 4,315,485

DATED : February 16, 1982

INVENTOR(S) : KAWAMURA AND HANEDA

It is certified that error appears in the above—identified patent and that said Letters Patent is hereby corrected as shown below:

Column 5, line 16, between "over" and "circuit" delete "-".

Column 7, line 27, change "inroduced" to --introduced--

Column 8, line 63, after "heating" change "surfce" to --surface--

Signed and Sealed this

*Twenty-fifth* Day of *May 1982*

[SEAL]

*Attest:*

GERALD J. MOSSINGHOFF

*Attesting Officer*

*Commissioner of Patents and Trademarks*